US006161338A

United States Patent [19]

Kuhns

[11] Patent Number: 6,161,338

[45] Date of Patent: Dec. 19, 2000

[54] RAIN GUTTER COVERS AND ROOF LINE PROTECTORS

[76] Inventor: Richard L. Kuhns, 210 Broad St., Red Bank, N.J. 07701

[21] Appl. No.: 09/283,552

[22] Filed: Apr. 1, 1999

Related U.S. Application Data

[60] Provisional application No. 60/080,482, Apr. 2, 1998.

[51] Int. Cl.[7] ..... E04D 13/076

[52] U.S. Cl. ..... 52/12; 210/474

[58] Field of Search ..... 52/11, 12; 210/474

[56] References Cited

U.S. PATENT DOCUMENTS

| | | | |
|---|---|---|---|
| 2,365,845 | 12/1944 | Schweda | 52/12 |
| 3,388,555 | 6/1968 | Foster . | |
| 4,411,110 | 10/1983 | Carey . | |
| 4,750,300 | 6/1988 | Winger, Jr. | 52/12 |
| 4,941,299 | 7/1990 | Sweers | 52/12 |
| 5,072,551 | 12/1991 | Manoogian, Jr. | 52/12 |
| 5,099,620 | 3/1992 | Carey | 52/12 |
| 5,216,851 | 6/1993 | Kuhns | 52/12 |
| 5,251,410 | 10/1993 | Carey | 52/12 |
| 5,305,562 | 4/1994 | Sapia | 52/11 X |
| 5,339,575 | 8/1994 | Kuhns . | |
| 5,375,379 | 12/1994 | Meckstroth | 52/12 |
| 5,383,310 | 1/1995 | Sapia | 52/12 |
| 5,457,916 | 10/1995 | Tenute | 52/12 |
| 5,471,798 | 12/1995 | Kuhns | 52/12 |
| 5,640,809 | 6/1997 | Iannelli | 52/12 |
| 5,660,001 | 8/1997 | Albracht | 52/12 |
| 5,966,875 | 10/1999 | Kuhns | 52/12 |

FOREIGN PATENT DOCUMENTS

| | | | |
|---|---|---|---|
| 3829384 | 3/1990 | Germany | 52/12 |

*Primary Examiner*—Laura A. Callo

*Attorney, Agent, or Firm*—Thomason, Moser & Patterson, LLP

[57] ABSTRACT

A cover for a rain gutter that prevents the gutter from becoming clogged with leaves or other debris while facilitating water entry to the gutter is disclosed. Specifically, the cover comprises a flange which may be disposed beneath the shingles of a roof, an substantially vertical apertured front portion containing aperture which divert the rain water into the gutter, a trough for collecting the water which fails to enter the apertures, and a second flange for connection to the gutter.

11 Claims, 6 Drawing Sheets

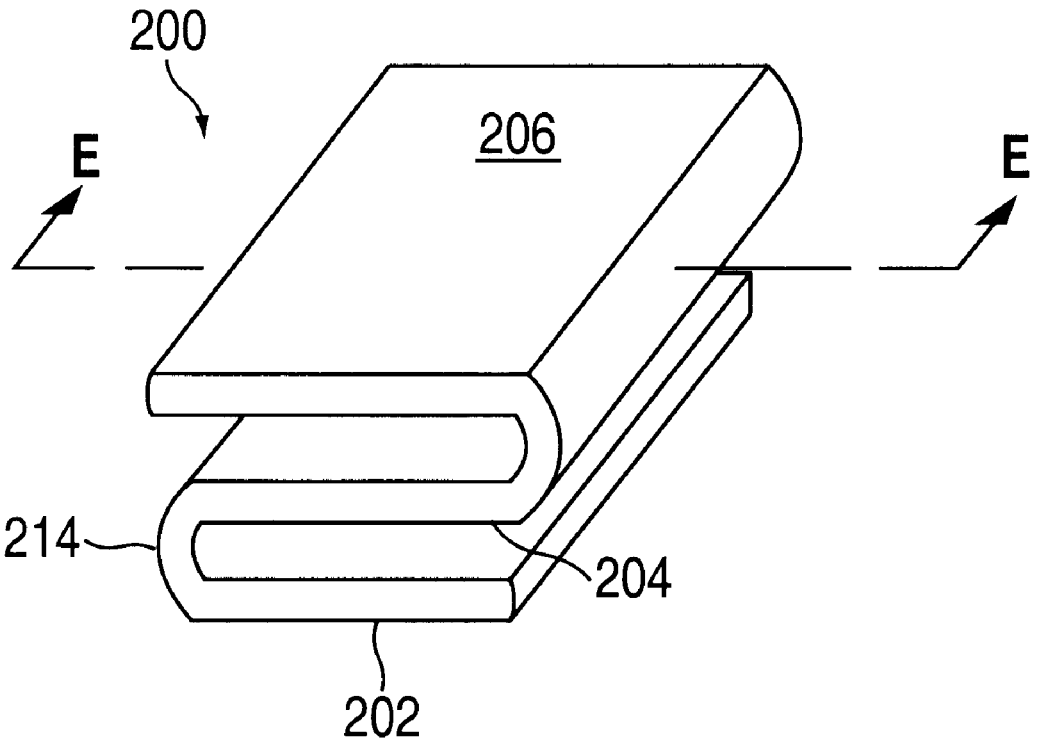
FIG. 5
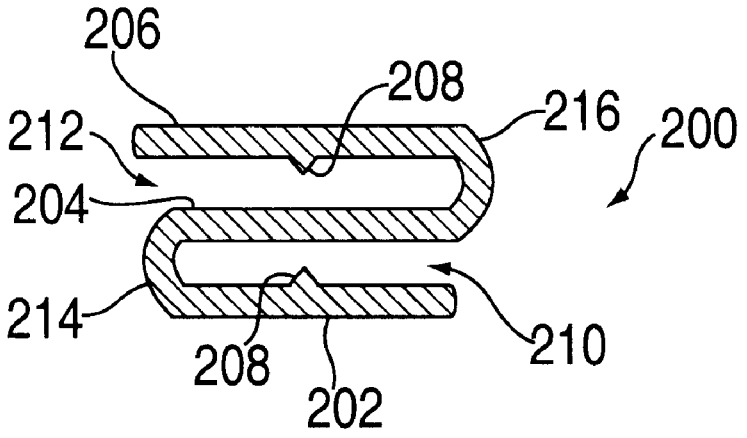
SECTION E-E

RAIN GUTTER COVERS AND ROOF LINE PROTECTORS

PRIORITY CLAIM TO A PROVISIONAL APPLICATION

This application claims the benefit of U.S. Provisional Application 60/080,482, filed Apr. 2, 1998 and hereby incorporates said application by reference.

BACKGROUND OF THE DISCLOSURE

1. Field of Invention

This invention relates to a covering and protector for existing rain gutters and roof-lines. More particularly, the invention relates to a gutter cover for closing the top of the gutter to prevent the gutter from becoming clogged by leaves and other debris. A further aspect of the invention is a double "S" shaped clip which facilitates the installation of the invention to existing gutters.

2. Description of the Background Art

U.S. Pat. No. 5,339,575 issued Aug. 23, 1994, (the disclosure of which is hereby incorporated by reference) describes a rain gutter assembly which is configured to form a closed top surface which is mounted so that it is downwardly slanted to an arcuate surface directing the water downward to an apertured portion containing a number of apertures each with a flap for directing rain into the surface of the gutter in a manner similar to that shown in Carey, U.S. Pat. No. 4,411,110. However other types of collectors may be utilized with these roof-line protectors containing one row of apertures such as shown in Kuhn's U.S. Pat. No. 5,471,798, or Foster's U.S. Pat. No. 3,388,555 containing three or more rows of apertures.

Directly beneath the aperture openings in the vertical 35 planes is a solid wall with a minimum height of 1/16". This solid wall may be provided with occasional slits or openings therein for passing uncollected water into the gutter. A flange portion extending from the bottom edge of the wall interfits beneath the upper lip of the front wall of the existing gutter and serves both to close the gutter at its front wall and to provide a surface for fastening the invention to the existing gutter with tapping screws. The preferred method of affixing the flange to the gutter is to attach the gutter to the underside of the gutter lip thereby providing a pathway for any water which bypasses the apertures to then enter the gutter through inherent openings between the flange and the top lip of the gutter.

Although this method of attachment works in collecting all the residual water missed by the apertured openings, the installation of the protector on existing gutters is often a difficult, time consuming and laborious task which often results in workers receiving lacerations to their hands while they attempt to interfit one protector over the next. Often times the spikes used as gutter fasteners are installed tight to the underside of the upper lip of the gutter making it extremely difficult and physically dangerous to slide the flange of the protector in between the spike and the underside of the gutter lip. Simply mounting the interfitting flange on top of the gutter lip would cause the residual water missed by the apertures to run over the front wall of the existing gutter leading to unsightly staining.

This method of attachment of the protector flange to the underside of the gutter lip is also ineffective in collecting any water that may fall onto the upper lip of the gutter itself which depending on the slant of the lip will either drain toward the collector or the front wall of the gutter and down said wall. Thus, unless the front lip of the gutter is slanted a certain way, there is no way of directing this water into the gutter.

U.S. Pat. No. 5,471,798 issued Dec. 5, 1995, (the disclosure of which is hereby incorporated by reference) describes a rain gutter assembly which is configured to form a closed top surface which is mounted so that it is downwardly slanted to a rounded corner. The assembly then extends vertically downwardly forming a front wall having a plurality of specially configured apertures herein. Each aperture includes a generally inwardly and downwardly extending flap provided along the top edge of the aperture for receiving and directing rain water into the gutter. The assembly then extends horizontally to connect to a substantially horizontal flange that is designed to interfit with a lip on a conventional rain gutter. The flange is attached intermittently by fasteners, such as sheet metal screws. The flange may be attached to either the top or the underside to the lip. Alternatively, the flange may be snap fit against the lip forming a seal between the lip and the flange.

To facilitate collecting any rain water that is not directed into the gutter by the flaps, the gutter cover contains a plurality of secondary apertures. The secondary apertures are located at a point where the vertical portion meets the flange, e.g., along the lower edge of the vertical portion. Each secondary aperture is partially formed in the vertical portion and partially formed in the flange. To direct the rain water into the rain gutter, each aperture contains a flap connected to the bottom edge of each aperture i.e., the primary apertures contain primary flaps and the secondary apertures contain secondary flaps. Thus, through surface adhesion, the rain water which is not directed into the gutter by the primary apertures will be directed into the gutter by the secondary apertures Although the secondary flaps effectively collect any residual water from the primary collector and direct it into the gutter, the invention is not practical to manufacture in that sharp edges protrude from the secondary flaps which can cause physical harm to the installer and the sharp edges from the secondary flaps make it extremely difficult to stack and pack the product for shipment. The protectors must be packed individually resulting in higher packing and shipping costs.

Another problem that is incurred in all the aforementioned art is that one must be skilled in the use of self tapping screws to affix the protectors to the gutter.

SUMMARY OF THE INVENTION

The present invention overcomes the disadvantages heretofore associated with the prior art Specifically, the present invention is an inventive gutter cover fabricated from a unitary sheet of metal or plastic, such as galvanized steel, painted steel, aluminum, copper, vinyl, and the like, having a first flange, an apertured front portion, a trough and a second flange. The first flange is configured as to allow for the covers installation beneath the shingles of a roof. The first flange allows for the uninterrupted flow of water from the roof onto the cover. The apertured front portion is attached to the first flange and is orientated in a substantially vertical position. The apertured front surface has at least one row of apertures which have an upper edge from which a flap is attached and disposed towards the gutter. As rain water runs down the apertured front portion the water adheres to the flap thus being directed into the gutter. Below the apertured front portion is a trough. The top of the trough terminates into a second flange which is orientated substantially perpendicular to the apertured front portion. Projected from the second flange is an imaginary plane which defines the top of the trough.

Any rain water which fails to be diverted into the gutter by the apertures and flaps is collected in the trough. The last row of apertures is positioned so that a lower edge of the aperture is below the imaginary plane, thus providing a path or access for the water collected in the trough to enter the gutter.

In a second embodiment, a slot may be orientated on the apertured front portion so that a portion of the slot lies below the imaginary plane to facilitate water drainage in configurations where the lower edge of the apertures does not lie below the imaginary plane.

In a third embodiment where it is deemed desirable or necessary to have more than one cover extending along the length of the gutter, a first and at least a second cover are fastened to the roof and gutter. In the portion in which the first and at least second covers overlap, the at least second cover is configured as to lay substantially flat atop the first cover so that the covers may be seemed longitudinally along an expansive roof line in an aesthetically pleasing and functional fashion.

All embodiments may be fashioned to the gutter using conventional fasteners, such as sheet metal screws. Other embodiment allows for the replacement of the conventional fastener with an "S" shaped clip. The "S" shaped clip has a first gap which captures the cover and a second gap which captures the lip of the gutter, thus securing the cover to the gutter.

BRIEF DESCRIPTION OF THE DRAWINGS

The teachings of the present invention can be readily understood by considering the following detailed description in conjunction with the accompanying drawings, in which:

FIG. 5 is a perspective and sectional view of the "S" shaped attachment clip; and, FIG. 6 is a perspective view of a third embodiment of the present invention.

To facilitate understanding, identical reference numerals have been used, where possible, to designate identical elements that are common to the figures.

DETAILED DESCRIPTION OF THE INVENTION

Figure 1:
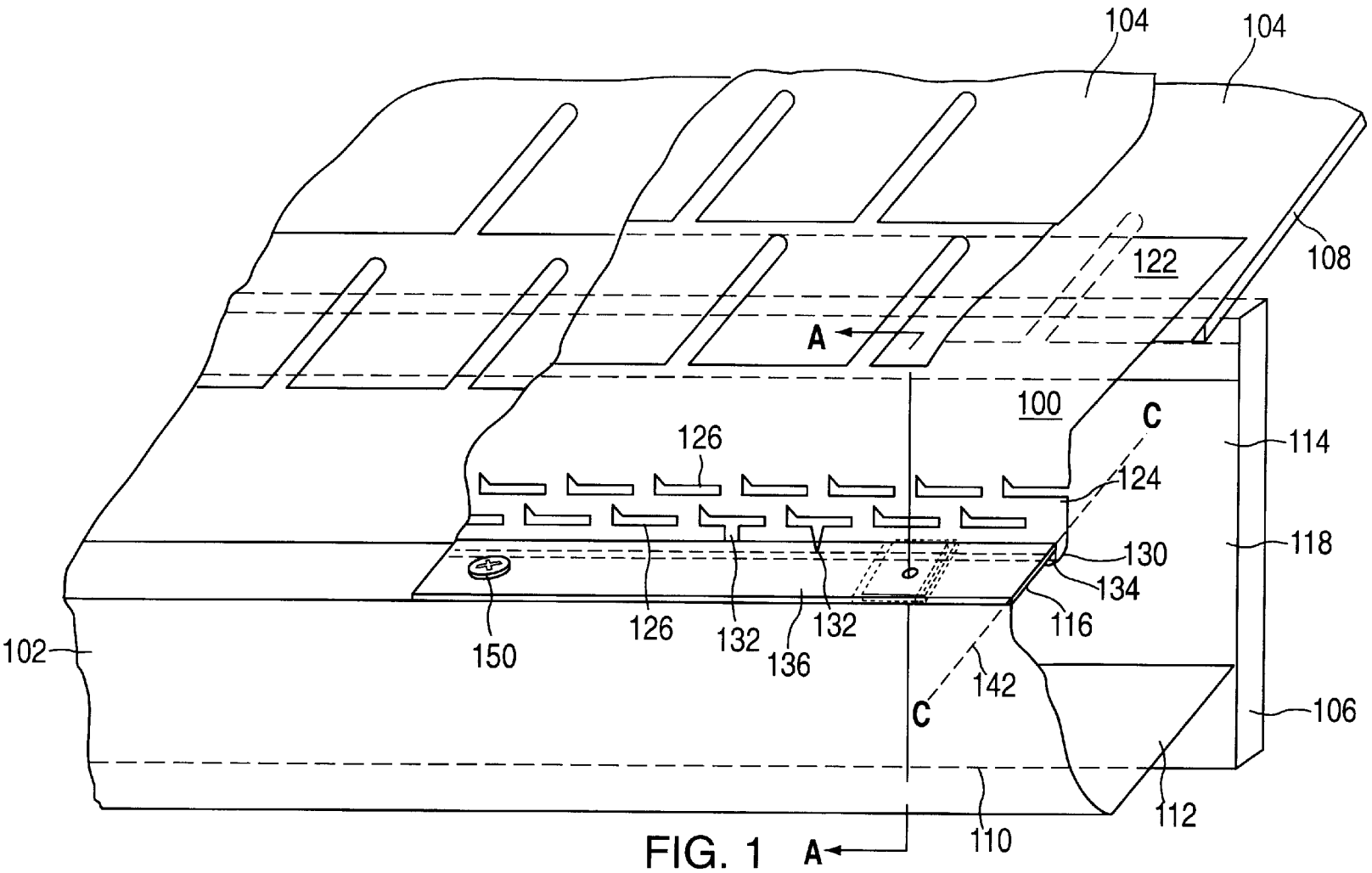
FIG. 1 is a perspective view of an embodiment of the present invention.

FIG. 1 depicts the inventive water collector or cover 100 installed under roofing shingles 104 of a building 106 having a sloped roof 108. Typically, the building 106 will employ a rain gutter 102 of the usual type attached to the building 106 adjacent to the roof 108 to collect rain water (not shown) running off the roof 108. The rain gutter 102 is of the type commonly used in the art, typically having a "U" shaped channel 118 for collecting rain water defined by a front side 110, a bottom 112, a back side 114 and a lip 116.

The cover 100 is fabricated from one unitary sheet of sheet metal or plastic, such as galvanized steel, painted steel, aluminum, copper, vinyl, and the like as to provide a relatively uninterrupted continuous path for rain to flow from the roof 108 onto the cover 100. However one skilled in the art may readily fabricate the cover from discrete sections or individual parts. The top portion 122 of cover 100 extends under the roof shingles 104. The top portion 122 transitions into an apertured front portion 124 which is substantially vertical in orientation, ending in a trough 130. The opposite wall 134 of the trough 130 is substantially parallel to the apertured front portion 124, and terminates in a front flange 136 oriented substantially perpendicularly to apertured front portion 124. An imaginary plane "CC" 142 projected from the front flange 136 and can be used to define the depth and volume of the trough 130. The trough can be range in depth minimally from 1/32"-to-1/4" and it's width can be from 1/32"-to-1" or more.

As depicted in FIG, 2, the front flange 136 sits above the lip 116 of the gutter 102. Affixing the front flange 136 to the lip 116 is a "S" shaped clip 200. Alternatively, conventional fasteners such as sheet metal screws 150 (see FIG. 1) and the like may be substituted for the "S" shaped clip 200.

The apertured front portion 124 contains one or more rows of apertures 126, for example, of the type disclosed in the aforementioned Carey '110 patent. The apertures 126 are typically polygonal, triangular, rectangular or trapezoidal in shape, and contain a flap 138. Flap 138 is connected to an upper edge 140 of each aperture 126 and projects inward towards the back side 114 of the gutter 102. Due to surface adhesion phenomenon, rain water flowing over the apertured front portion 124 adheres to the flap 138 and is channeled into the gutter 102.

The apertured front portion 124 terminates in the trough 130. The trough 130 collects the rain water which fails to be diverted by flaps 138 into the gutter 102. Between the trough 130 and the rows of apertures 126 are a plurality of slots 132 (see FIG. 1) which extend below the imaginary plane "CC" 142 to permit the flow of water into the gutter 102 which collects in the trough 130. The size, shape and number of the slots 132 may be varied as to effect the water flow as desired. If the use of the slots 132 are not desired, the bottom edge 144 of the lowest row of apertures 126 may be below the plane 142 to allow the water to drain into the gutter 102.

The "S" shaped clip 200 is detailed in FIG. 5 as having a bottom member 202, a middle member 204, and a top member 206 which are substantially parallel to one another. The middle member 204 is connected by a first connecting member 214 to the bottom member 202 defining a first gap 210, and a second connecting member 216 the other end of the middle member 204 connecting the middle member 204 to the top member 206 defining a second gap 212, forming an "S" shape. Both the bottom and top members, 202 and 206, respectively, contain raised bumps 208 which protrude into the gaps 210 and 212, respectively.

Figure 2:
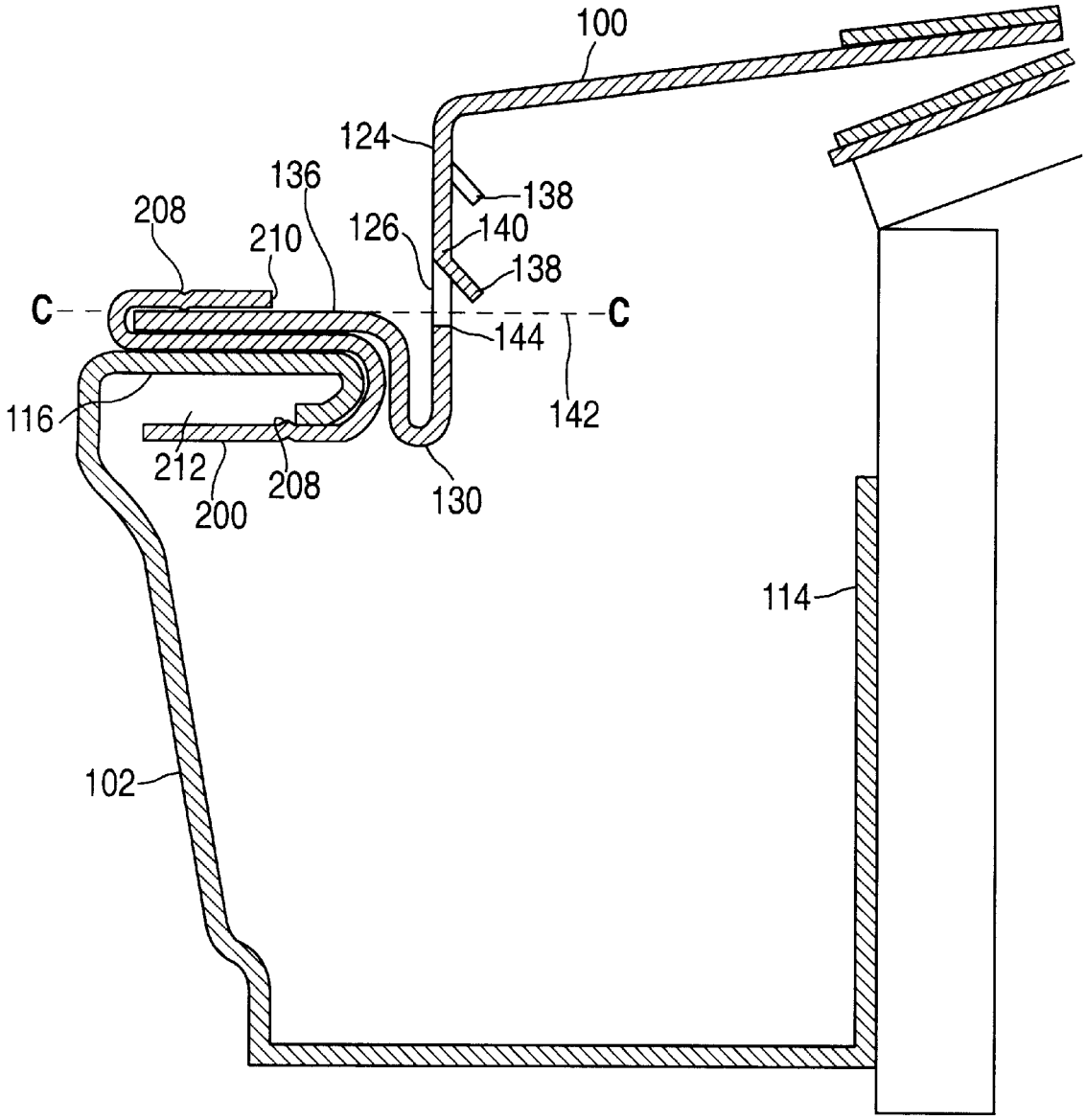
FIG. 2 is a sectional view along section line A—A of the embodiment shown in FIG. 1.

Referring back to FIG. 2, the front flange 136 of the cover 100 "nests" in the first gap 210. The lip 116 of the gutter 102 "nests" in the second gap 212. The raised bumps 208 provide friction to retain the second flange 136 in the first gap 210 and the lip 116 in the second gap 212. Alternately, the bumps 208 may provide a snap-fit to retain the second flange 136 and lip 116 within the respective first and second gaps, 210 and 212. Other fastening methods employing the "S" shaped clip 200 may be readily substituted by one skilled in the art such as screws or adhesives In operation, rain water running down the roof shingles 104 flows over the top portion 122 of the cover 100. The rain water then flows down the apertured front portion 124 of the cover 100 and is diverted into the gutter 102 via apertures 126 and flaps 128. The water which fails to be diverted through the apertures 126 is collected in a trough 130 and is drained into the gutter via the slots 132.

Figure 3:
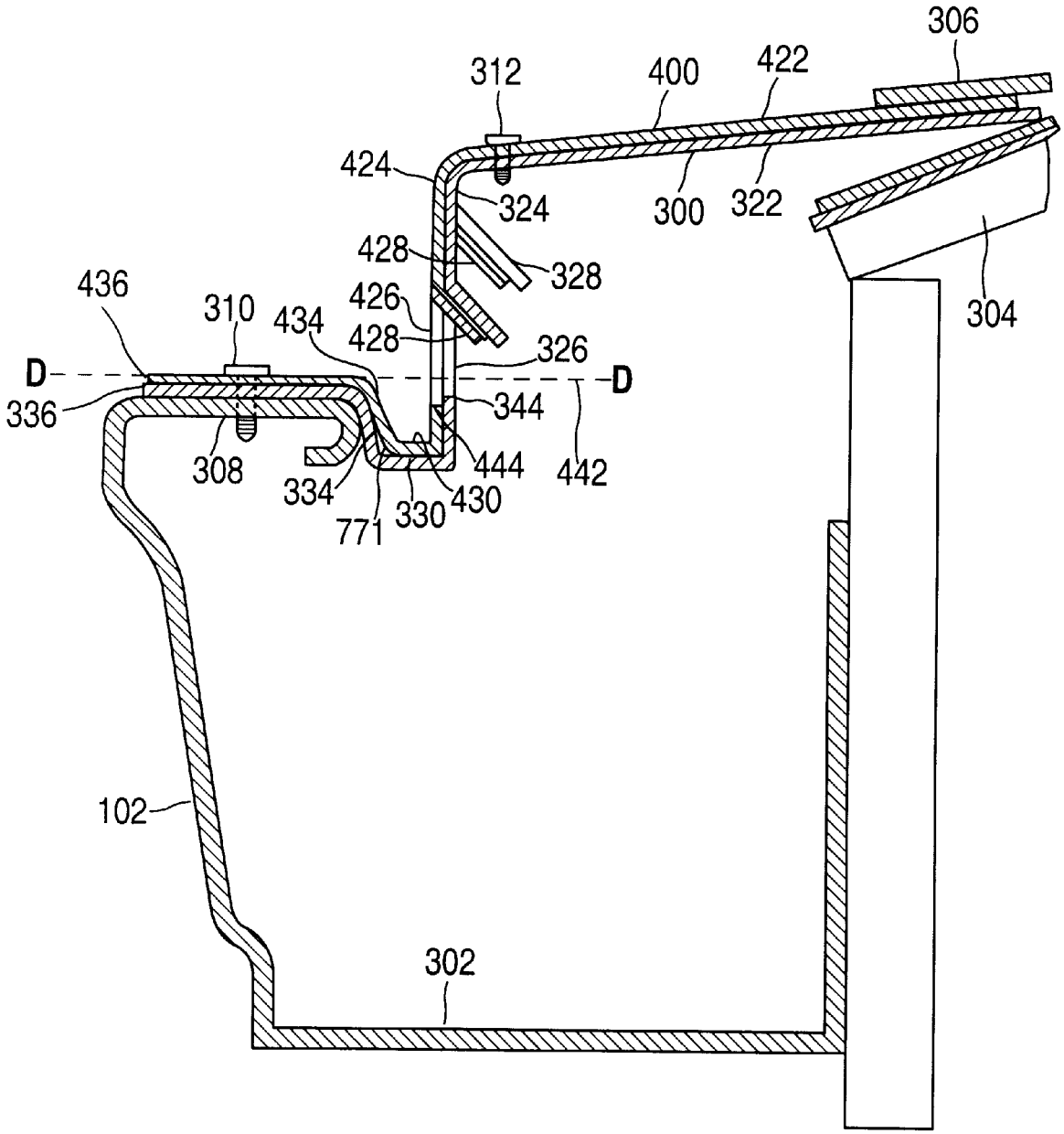
FIG. 3 is a sectional view along section line B—B of the embodiment shown in FIG. 6.
Figure 6:
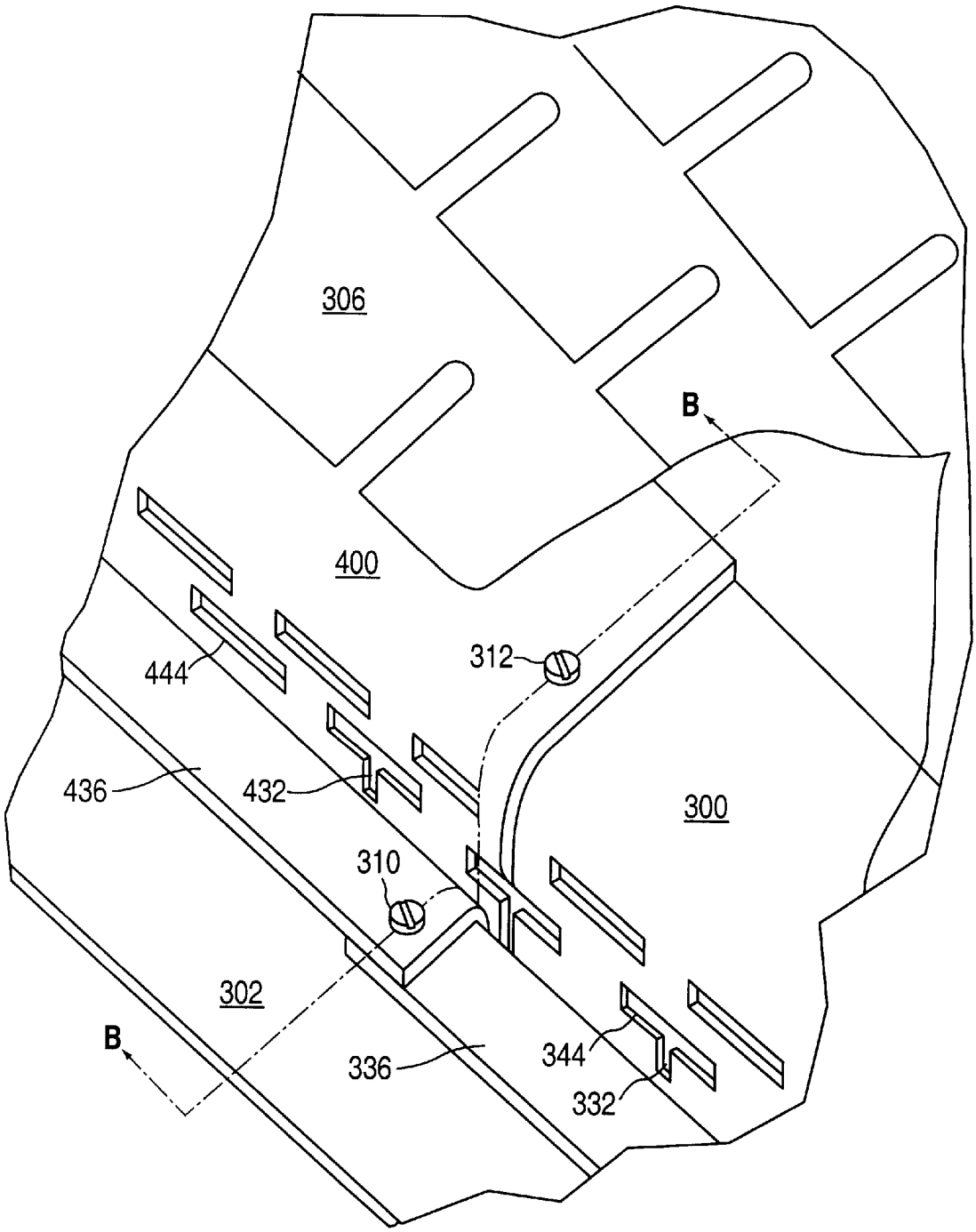

FIG. 3 depicts another embodiment of the present invention. FIG. 3 depicts a first cover 300 and a second cover 400 where they join and overlap as shown in FIG. 6 along B—B installed to a gutter 302 and a roof 304. The top portion 322 of cover 300 extends under the roofing shingles 306. The top portion 322 transitions into an apertured front portion 324. The apertured front portion 324 contains one or more rows of apertures 326. Each aperture 326 has a flap 328. The apertured front portion 324 terminates in trough 330 of cover 300.

Front wall 334 of the trough 330 is located opposite and parallel to the apertured front portion 324. The front wall 334 transitions into a front flange 336 which sits above a lip 308 of the gutter 302.

Cover 400 has a top portion 422 which extends under the roofing shingles 306. Portion 422 transitions into an apertured front portion 424 which nests within the apertured portion of apertured portion 324 of cover 300 where the covers are joined together. The apertured front portion 424 of cover 400 contains one or more rows of apertures 426. Each aperture 426 has a flap 428. The apertured front portion 424 terminates in trough 430.

The front wall 434 of trough 430 is located opposite the apertured front portion 424 of cover 400. The front wall 434 transitions into a front flange 436 which sits above the flange 336 of cover 300 and lip 308 of the gutter 302. Covers 300 and 400 are overlapped minimally (e.g., 1/32") where they join (referencing FIG. 6), and are then affixed to the gutter 302 by installing a sheet metal screw 310 through covers 300 and 400. Into the lip 308 of gutter 302 as seen in FIG. 3. Alternatively, the "S" shaped attachment clip discussed above may also be used to attach covers 300 and 400 to lip 308. A second sheet metal screw 312, rivet, or other similar fastener may be installed through the top portion 322 of cover 300 and the top portion 422 of cover 400 to better secure cover 300 and cover 400 together where they overlap and join.

Referring to FIG. 3 and FIG. 6 simultaneously, a variation of the above embodiment contains a plurality of slots 332 and 432 in the apertured front portions 324 and 424, respectively, which extend below the imaginary plane "DD" 442 to permit the flow of water that collects in the trough 430 into the gutter 301. If the use of the slots 332 and 432 are not desired, the bottom edges 344 and 444 of the lowest row of apertures 326 and 426, respectively, may be below the plane 442 to allow the water to drain into the gutter 302.

Alternatively, referring to FIG. 3, if neither the use of slots 332 or 432 or the bottom edge 344 of the lowest rows of apertures 326 and 426 extend below plane 442 to allow water to drain into gutter 302 another embodiment of this invention is shown. An inherent opening 771 is formed between the trough 330 and 430 of covers 300 and 400. The adjacent edges of 334 and 434 of both covers form flaps from the overlapping of the troughs 330 and 430 which because the angles of the front walls 334 and 434 are different, and inherent space 771 is formed between them which serves to deliver any water in trough 430 into the gutter 302. During rain fall conditions temperatures outside the gutter 302 and covers 300 and 400 are cooler than temperatures inside the gutter 302 and cover 300 and 400. This difference in temperatures creates a minor pressure difference such that the pressure inside the gutter 302 and covers 300 and 400 is lower pressure than the pressures outside the gutter 302 and covers 300 and 400. The combination of this pressure differential and surface adhesion causes any water in the trough to be drawn through the inherent opening 771. The opening is sufficiently small enough to keep debris from entering the gutter 302.

Figure 4:
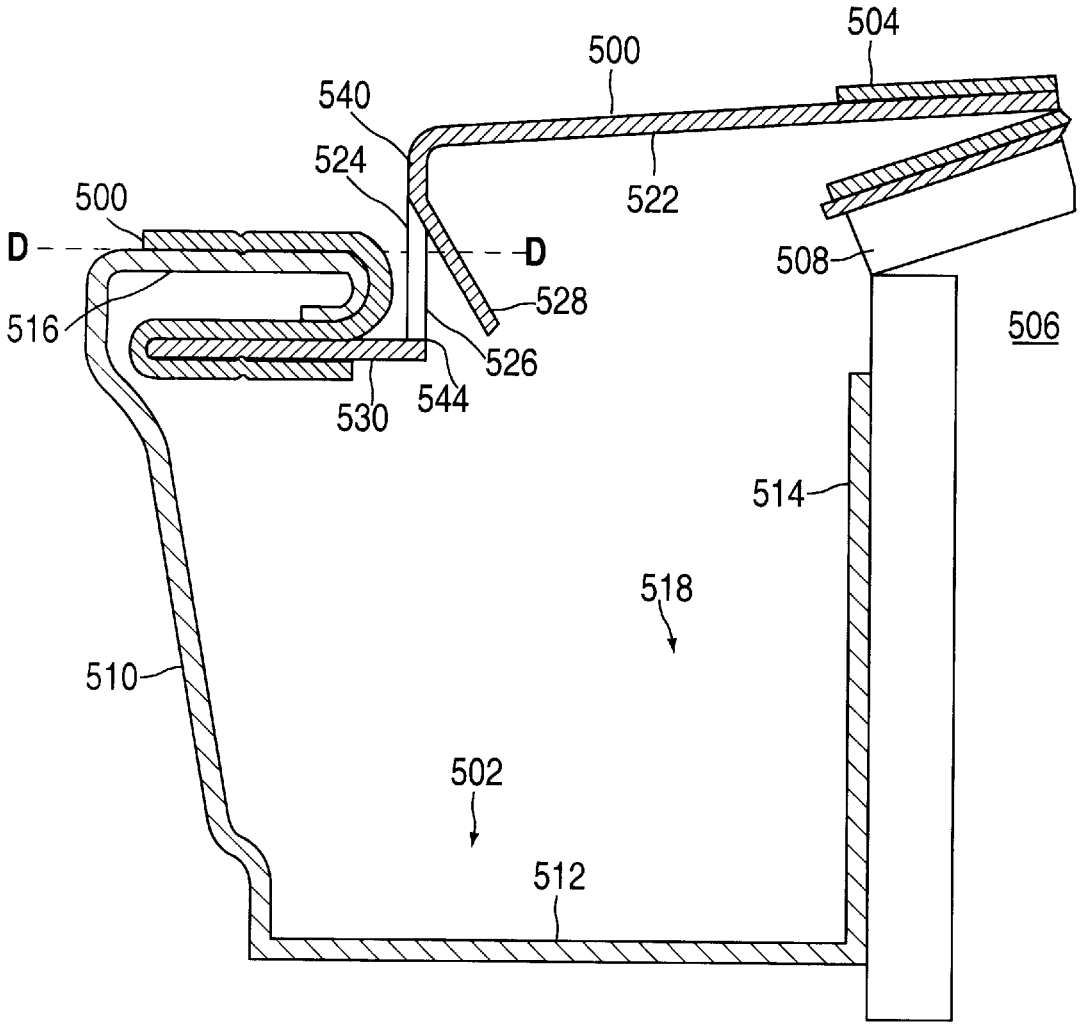
FIG. 4 is a sectional view of a second embodiment of the present invention using attachment clips to secure the present invention to a gutter.

FIG. 4 depicts a third embodiment of the present invention. FIG. 4 depicts a cover 500 installed under the roofing shingles 504 of a building 506. Typically, the building 506 will employ a rain gutter 502 of the usual type attached to the building adjacent to the roof 508 to channel rain water (not shown) running off the roof 508. The rain gutter 502 is of the type commonly used in the art, typically having a "U" shaped channel 518 for collecting rain water defined by a front side 510, a bottom 512, a back side 514 and a lip 516. The cover 500 is fabricated from one unitary sheet of sheet metal or plastic as to provide a relatively uninterrupted continuous path for rain to flow from the roof 508 onto the cover 500. However, one skilled in the art may readily fabricate the cover 500 in discrete sections or form individual panels.

The cover 500 has a top portion 522 which extends under the roofing shingles 504. The top portion 522 transitions into an apertured front portion 524. The apertured front portion 524 contains at least one row of apertures 526. The apertures 526 are typically polygonal, traingular, rectangular, or tapezoidal in shape, and contain a flap 528. The flap 528 is connected to an upper edge 540 of each aperture 526 and projects inward. The lower edge 544 of aperture 526 is even with the edge of the aperture front portion 524. Due to surface adhesion phenomenon, rain water flowing over the apertured front portion 524 adheres to the flap 528 and is channeled into the gutter 502. The apertured front portion 524 terminates in to a bottom most front flange 530 which is oriented substantially perpendicular to the apertured front portion 524. The front flange 530 sits above the lip 516 of the gutter 502. Affixing the front flange 530 to the lip 516 is a "S" shaped clip 500. shown in FIG. 5. Alternatively, conventional fasteners such as sheet metal screws, rivets and the like may be substituted for the "S" shaped clip 500.

Although various embodiments which incorporate the teaching of the present invention have been shown and described in detail herein, those skilled in the art can readily devise many other varied embodiments that still incorporate these teachings and do not depart from the spirit of the invention.

What is claimed is:

1. A water collector comprising:

a first cover having a first top portion;

a first apertured front portion, connected to said top portion, having at least one row of first apertures, each of said first apertures having a flap connected to an upper edge;

a first trough connected to said first apertured front portion;

a first flange connected to said first trough;

at least a second cover having a second top portion;

a second apertured front portion, connected to said second top portion, having at least one row of second apertures, each of said second apertures having a flap connected to an upper edge;

a second trough connected to said second apertured front portion; and a second flange connected to said second trough; said second cover fastened to said first cover, forming an opening between said first and said second trough.

2. The collector of claim 1 wherein said first and second apertured front portions further comprise:

a plurality of slots in said first and second apertured front portions respectively between said first and second apertures and said first and second troughs.

3. The collector of claim 1 further comprising:

a clip having a first member;

a middle member coupled to said first member; and a third member coupled to said middle member, said first, middle and third member being substantially parallel to one another forming an "S" shape, said first and middle member defining a first gap, said third and middle member defining a second gap, said first and second flange being captured by said second gap.

4. The water collector of claim 3 wherein the clip further comprises:

a first raised bump on said first member protruding into said first gap; and a second raised bump on said third member protruding into said second gap.

5. The collector of claim 1 wherein said first and second apertured front portions are galvanized steel, painted steel, aluminum, copper or vinyl.

6. The collector of claim 1, wherein said first trough further comprises:

a front wall having a first angle; and wherein said second trough further comprises:

a front wall having a second angle different than said first angle.

7. A water collector comprising:

a first cover having a first top portion;

a first apertured front portion, connected to said top portion, having at least one row of first apertures, each of said first apertures having a flap connected to an upper edge;

a first trough having front wall a first angle connected to said first apertured front portion;

a first flange connected to said first trough;

at least a second cover having a second top portion;

a second apertured front portion, connected to said second top portion, having at least one row of second apertures, each of said second apertures having a flap connected to an upper edge;

a second trough having a front wall at a second angle, said second trough connected to said second apertured front portion; and a second flange connected to said second trough; said second cover disposed over a portion of said first cover, wherein the difference in the first angle and the second angle forms an opening between said first and said second trough.

8. The collector of claim 7 wherein said first and second apertured front portions further comprise:

a plurality of slots in said first and second apertured front portions respectively between said first and second apertures and said first and second troughs.

9. The collector of claim 7 further comprising:

a clip having a first member;

a middle member coupled to said first member; and a third member coupled to said middle member, said first, middle and third member being substantially parallel to one another forming an "S" shape, said first and middle member defining a first gap, said third and middle member defining a second gap, said first and second flange being captured by said second gap.

10. The water collector of claim 9 wherein the clip further comprises:

a first raised bump on said first member protruding into said first gap; and a second raised bump on said third member protruding into said second gap.

11. The collector of claim 7 wherein said first and second apertured front portions are galvanized steel, painted steel, aluminum, copper or vinyl.

* * * * *